US006474373B1

(12) United States Patent
Sejnowski

(10) Patent No.: US 6,474,373 B1
(45) Date of Patent: Nov. 5, 2002

(54) INFLATABLE DEVICE WITH LIQUID-POWERED AIR PUMP

(75) Inventor: Joseph P. Sejnowski, N. Kingstown, RI (US)

(73) Assignee: Item New Product Development, Providence, RI (US)

( * ) Notice: Subject to any disclaimer, the term of this patent is extended or adjusted under 35 U.S.C. 154(b) by 0 days.

(21) Appl. No.: 09/845,949

(22) Filed: Apr. 30, 2001

(51) Int. Cl.[7] ..... B65B 1/04; B65B 3/04; B67C 3/02

(52) U.S. Cl. ..... 141/102; 141/67; 141/100; 141/114; 141/325; 141/326; 4/492; 417/405

(58) Field of Search ..... 141/37, 41, 67, 141/99, 100, 102, 114, 231, 234, 247, 313, 325, 326; 417/405, 407, 313; 4/492, 541.6, 506

(56) References Cited

U.S. PATENT DOCUMENTS 832,100 A 10/1906 Tingley
876,152 A 1/1908 Douds et al.
913,592 A 2/1909 Ware
1,464,443 A 8/1923 Powell
2,926,836 A 3/1960 Marsh et al.
3,359,884 A 12/1967 Statter
5,992,447 A 11/1999 Miller et al.
6,094,773 A * 8/2000 Krentz et al. ..... 15/321
6,220,828 B1 * 4/2001 Lau ..... 4/492

* cited by examiner

*Primary Examiner*—Timothy L. Maust
(74) *Attorney, Agent, or Firm*—Barlow, Josephs & Holmes, Ltd.

(57) ABSTRACT

An inflatable device with a liquid-powered air pump includes a pump housing a liquid chamber and an air chamber, each having an input port and an output port. A turbine axle extends between the liquid chamber and the air chamber. The end of the turbine axle, residing in the liquid chamber, includes a number of liquid turbine blades while the end of the turbine axle, residing in the air chamber, includes a number of air turbine blades. A nozzle, which is preferably adjustable, is connected to the input port to the liquid chamber. Introduction of liquid into the liquid input port turns the liquid turbine blades and thus the air turbine blades via the axle. Air is drawn from the air input port and forced through the air output port. The pump assembly may be connected to or integrated with an inflatable device to simultaneously fill a liquid container and a separate air bladder of the inflatable device.

44 Claims, 7 Drawing Sheets

INFLATABLE DEVICE WITH LIQUID-POWERED AIR PUMP

BACKGROUND OF THE INVENTION

The present invention relates generally to inflatable devices, such as child swimming pools, inner tubes, rafts and other toys. In addition, the present invention relates to inflatable devices and apparatuses used for filling such inflatable devices with air and water. The present invention relates to the automatic and simultaneous filling of portions of an inflatable device with air an other portions with water.

In the inflatables industry, many different types of devices are available. For example, inflatable swimming pools are particularly popular for use and enjoyment by children. These prior art swimming pools are commonly made of PVC (polyvinyl chloride) and formed, for example, into a cylindrical configuration where the upstanding wall is a tube that is inflatable with air. A bottom floor is typically heat sealed to one end of the inflatable cylinder to form a reservoir for receipt of water therein. A closable valve port is typically provided in the outer wall of the inflatable pool to allow for the introduction of air to inflate the device. Air is typically introduced manually by the user putting their mouth on the valve and blowing air therein. When the device is inflated to the desired amount, the user stops blowing and the valve port is closed and by affixing a closure to the valve to maintain air within the device. Alternatively, a separate mechanical pump may be fitted with a nozzle of the appropriate size to interface with the valve port. Such mechanical pumps are commonly hand or foot driven or may include an electrical motor to facilitate air pumping.

There have been many attempts in the prior art to facilitate the pumping of air into an inflatable device. Electrical mechanical pumps have been incorporated directly into an inflatable device so that upon turning on the pump, the device will inflate as desired. Also, mechanical pumps, in the form of integrated bladders have been incorporated into inflatable devices where the bladder is squeezed to pump air and inflate the device. These foregoing pump devices and devices are found in sporting equipment, such as baseball gloves and athletic shoes, and portable sleeping mattresses. While these devices are capable of filling a device with air, they are not well-suited for inflating a device with air and also filling a portion of the device with liquid, such as water. As a result, these known integrated pumps cannot be employed to fill a child's inflatable swimming pool with water while still being able to inflate the body of the swimming pool with air.

Further the prior art pump devices are expensive to manufacture and integrate into the inflatable device. These devices are particularly awkward and difficult to use. Electric pumps require a power source, such as an electrical outlet, and are not safe for use near water such as what is always present around a child swimming pool inflatable device. Further, due to the small pumping capacity of manual foot or hand air pumps, these devices are inappropriate for inflating large inflatable devices, such as child swimming pools. In summary, the prior art air pumps and inflatable devices are not appropriate for addressing the needs of both inflating an inflatable device with air and filling it with water for use. In addition, water-powered turbines are generally shown in the prior art, however, they are not suitable for integration into an inflatable device or for the controlled simultaneous delivery of both water and air.

In view of the foregoing, there is a demand for a pump that can deliver both air to an inflatable as well as water for filling the device. There is a demand for a liquid-powered air pump that can be easily incorporated into an inflatable device that uses readily available water to power the air pump. There is a demand for an inflatable device to have an integrated air pump that greatly facilitates the air inflation and water filling process of preparing an inflatable device, such as child's swimming pool, for use. There is a further demand to obviate the need for manual air pumping to fill an inflatable with air. In addition, there is a demand for an inflatable device with a liquid-powered air pump that does not require electricity and is safe for use near water. Finally, there is a demand for an inflatable device with a liquid-powered air pump that is easy to operate, even by a child.

SUMMARY OF THE INVENTION

The present invention preserves the advantages of prior art liquid-powered air pumps and inflatable devices. In addition, it provides new advantages not found in currently available pumps and inflatable devices and overcomes many disadvantages of such currently available devices.

The invention is generally directed to the novel and unique liquid-powered air pump that can be easily incorporated directly within an inflatable device, such as a swimming pool or child's water toy. The present invention relates to a liquid-powered air pump that, when incorporated into an inflatable device, can simultaneously fill the device with a liquid while using that liquid to pump air to inflate the device. For example, the liquid-powered air pump of the present invention can be incorporated into a child's inflatable swimming pool so that the flow of water filling the center of the pool drives an air pump to simultaneous fill the inflatable portion of the pool with air.

The liquid-powered air pump and associated inflatable device has many advantages over prior art air pumps and known inflatables. The liquid-powered air pump of the present invention includes a pump housing having a liquid chamber and an air chamber, each having an input port and an output port. A turbine axle extends between the liquid chamber and the air chamber. The end of the turbine axle, residing in the liquid chamber, includes a number of liquid turbine blades while the end of the turbine axle, residing in the air chamber, includes a number of air turbine blades. An adjustable nozzle is connected to the input port to the liquid chamber. Introduction of liquid into the liquid input port turns the liquid turbine blades and thus the air turbine blades via the axle. Air is drawn from the air input port and forced through the air output port. The pump assembly may be connected to or integrated directly within an inflatable device to simultaneously fill a liquid container and a separate air bladder of the inflatable device.

It is therefore an object of the present invention to provide an improved liquid-powered air pump that simultaneously delivers liquid and air to an inflatable device.

It is an object of the present invention to provide an improved liquid-powered air pump that does not require electricity.

It is a further object of the present invention to provide an improved air pump that does not require the user to manually pump the air.

Another object of the present invention is to provide an improved liquid-powered air pump that can control the flow of water and air to the inflatable device.

A further object of the present invention is to provide an improved liquid-powered air pump that can be incorporated into an inflatable swimming pool to simultaneously fill the pool with water and inflate the pool itself with air.

Another object of the present invention is to provide an improved liquid-powered air pump that can be connected to an inflatable toy to simultaneously fill the base of the toy with water and fill the inflatable portion of the toy with air.

A further object of the present invention is to provide an improved liquid-powered air pump that is inexpensive to manufacture.

Another object of the present invention is to provide an improved liquid-powered air pump that can be easily attached directly to an inflatable device to provide an integrated air source to the inflatable device.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 5:
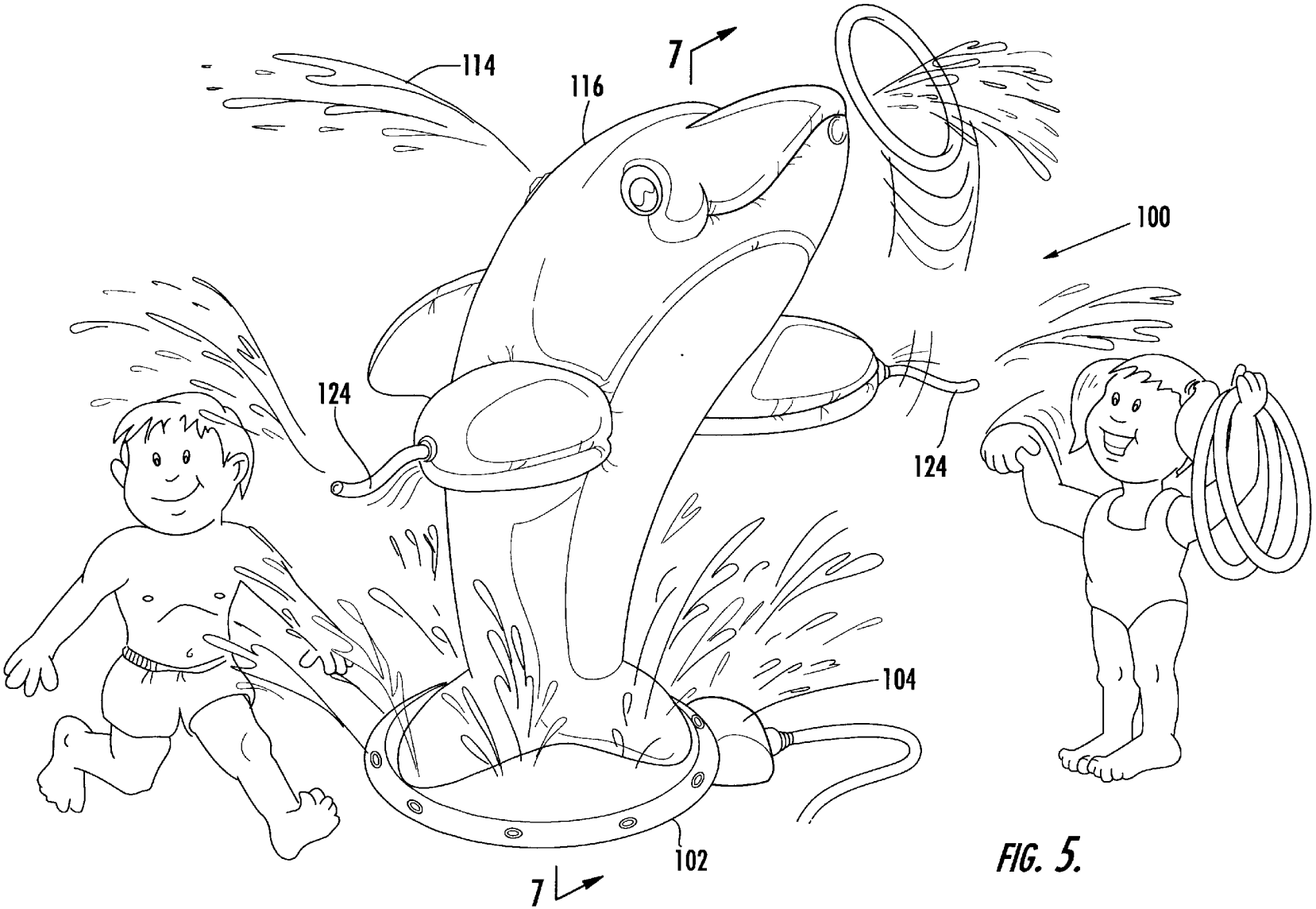
FIG. 5 is a perspective view of an alternative embodiment of the inflatable device with liquid-powered air pump of the present invention.
Figure 6:
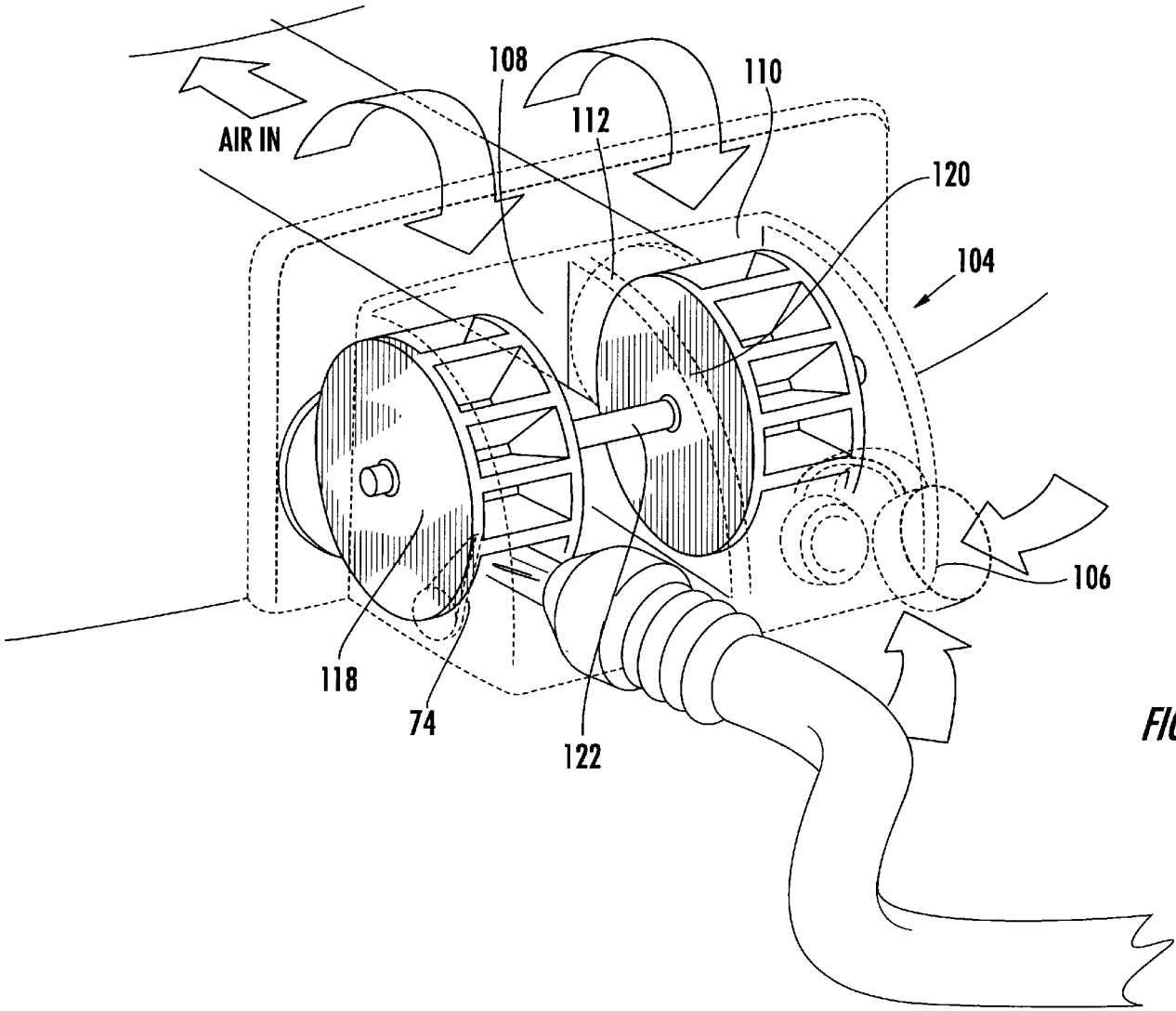
FIG. 6 is a close-up perspective view of the liquid-powered air pump of FIG. 5 with housing shown in broken lines for illustration purposes.
Figure 7:
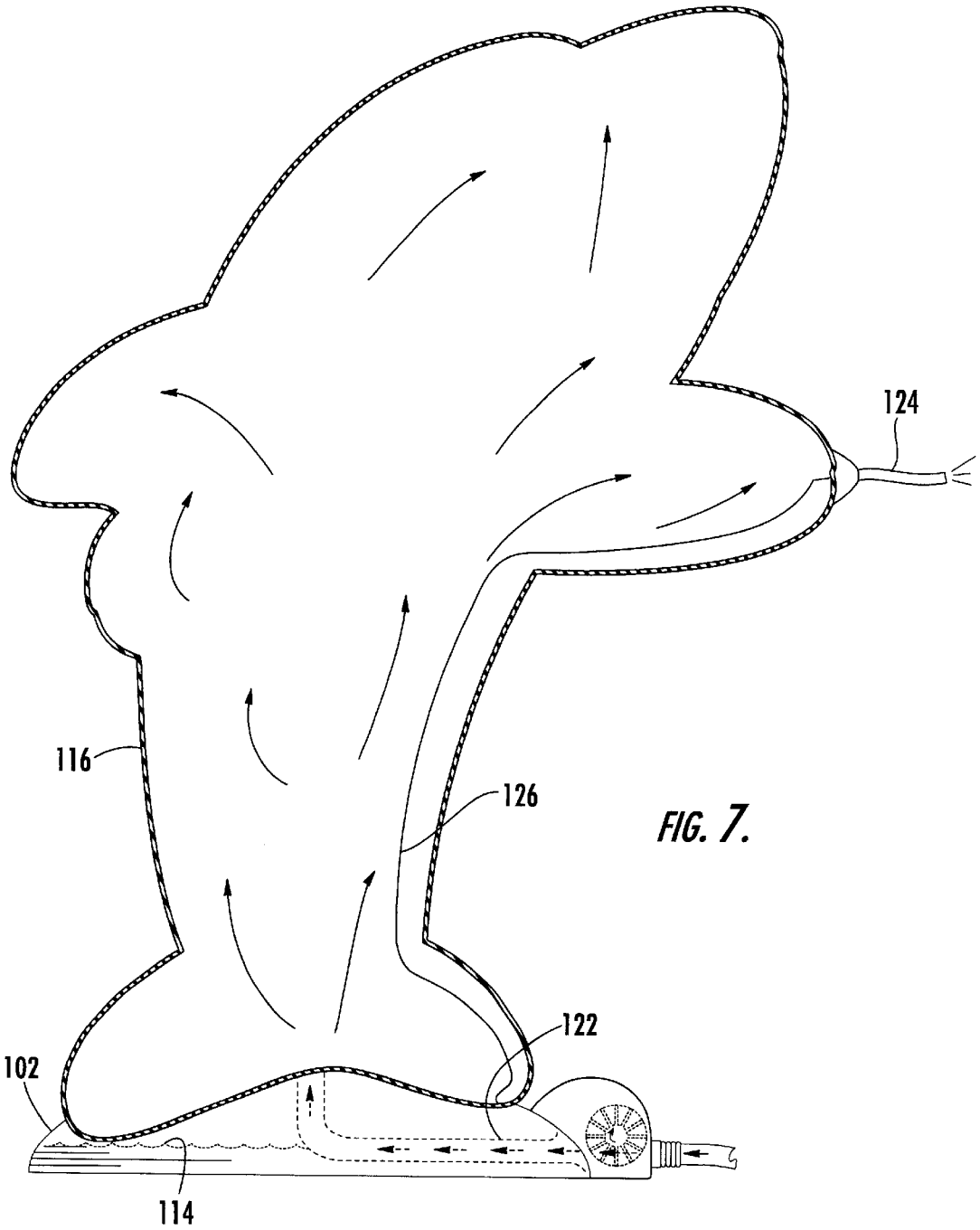
FIG. 7 is a cross-sectional view through the line 7—7 of FIG. 5.

The inflatable device 10 with liquid-powered air pump 12 of the present invention may be configured in many different ways. A first embodiment of the invention is shown in FIGS. 1–4 while a second embodiment is shown in FIGS. 5–7. These embodiments are two examples of an application of the present invention. The preferred embodiment, as shown in FIGS. 1–4, is in the configuration of an inflatable swimming pool 14 that is to be inflated with air to form the device and also filled with water to serve as a pool 14. An alternative embodiment, as shown in FIGS. 5–7, is in the configuration of an inflatable toy 100 that is inflated with air and includes a base 102 that is filled with water. The foregoing embodiments are just two examples of how the apparatus of the present invention can be configured for actual use. Other variations, employing the present invention, are intended to be within the scope of the present invention. For ease of illustration and description of the present invention, the foregoing preferred embodiment of FIGS. 1–4 and alternative embodiment of FIGS. 5–7 will be discussed in detail herein.

Figure 1:
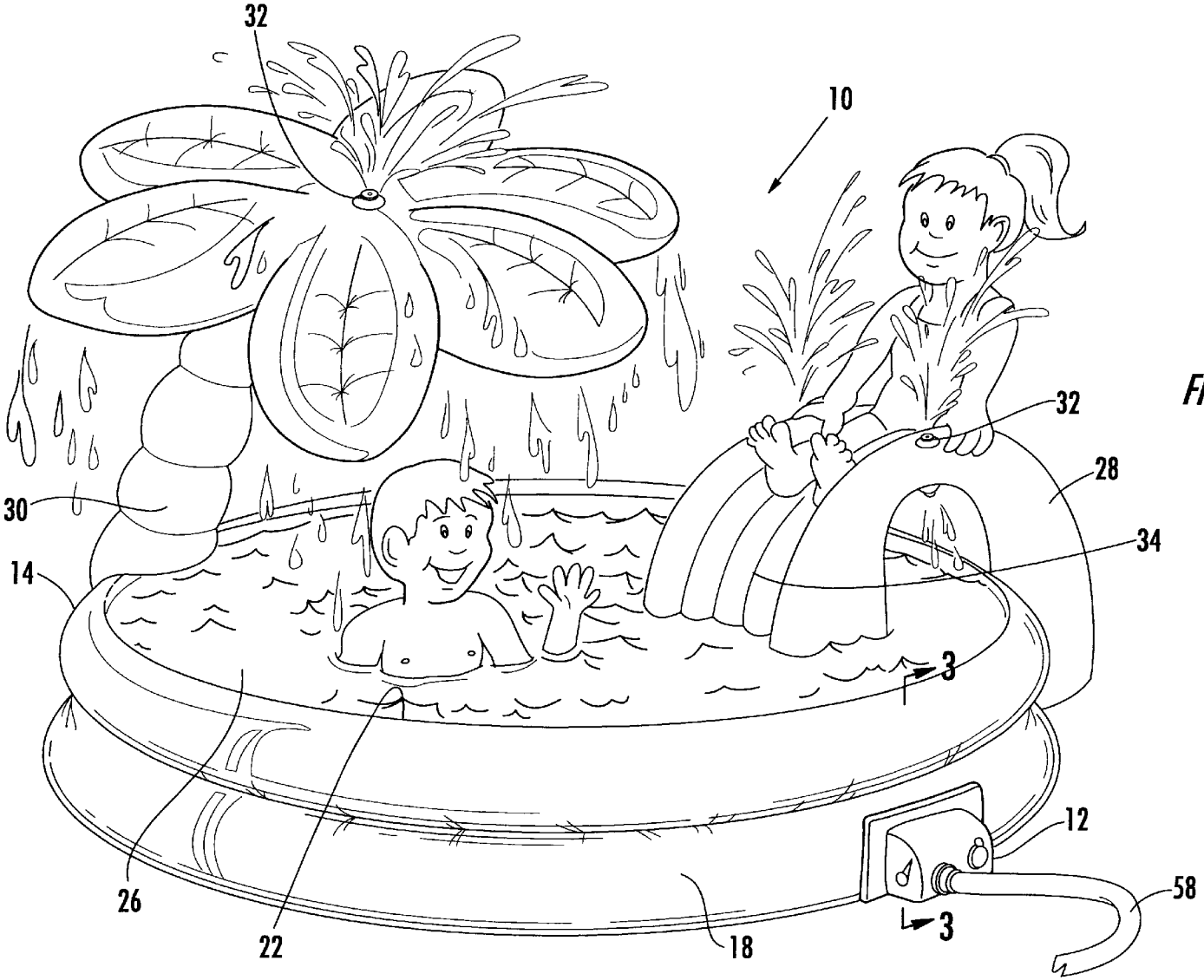
FIG. 1 is a perspective view of the inflatable device with liquid-powered air pump of the present invention.
Figure 2:
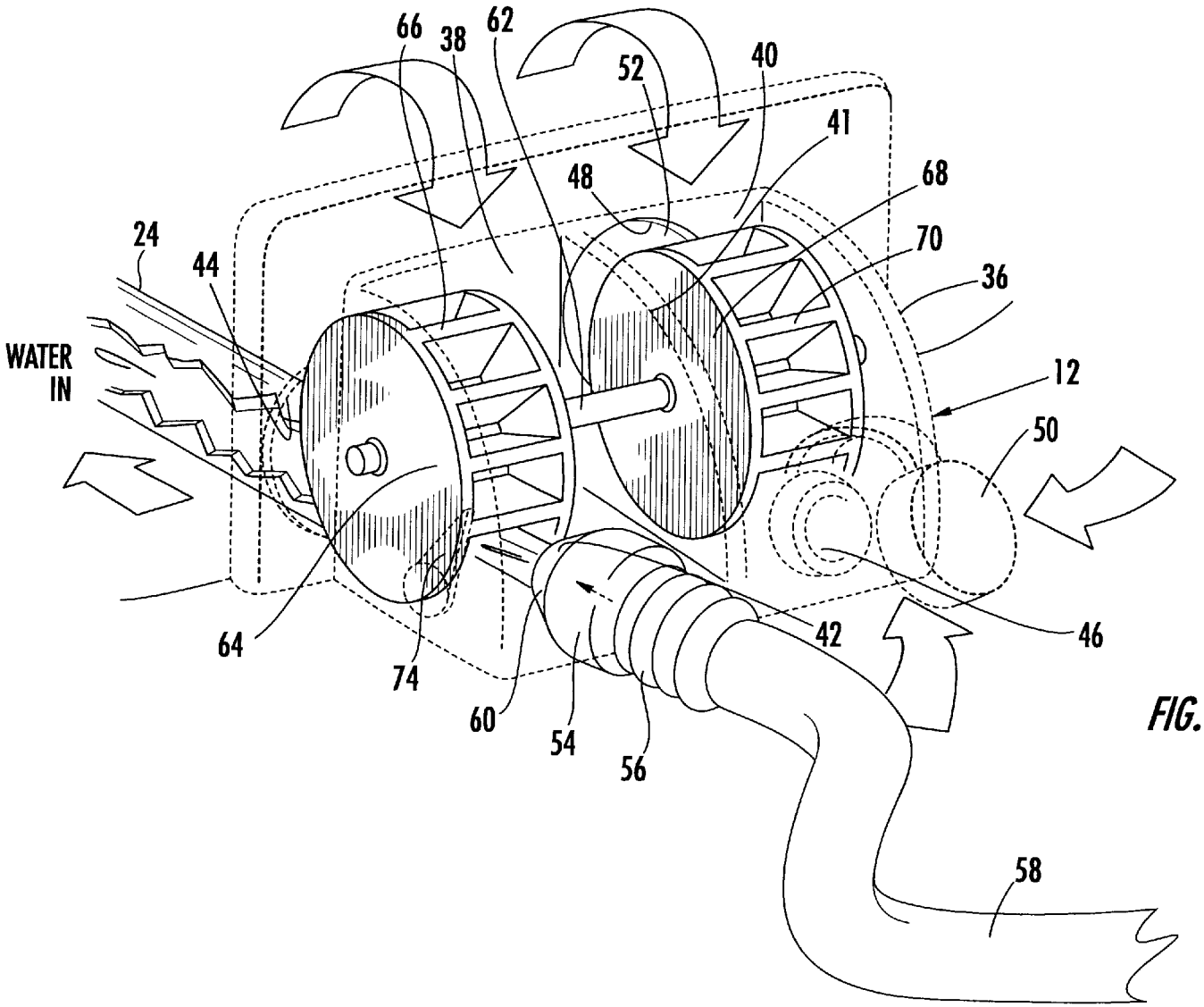
FIG. 2 is a close-up perspective view of the liquid-powered air pump of FIG. 1 with housing shown in broken lines for illustration purposes.
Figure 3:
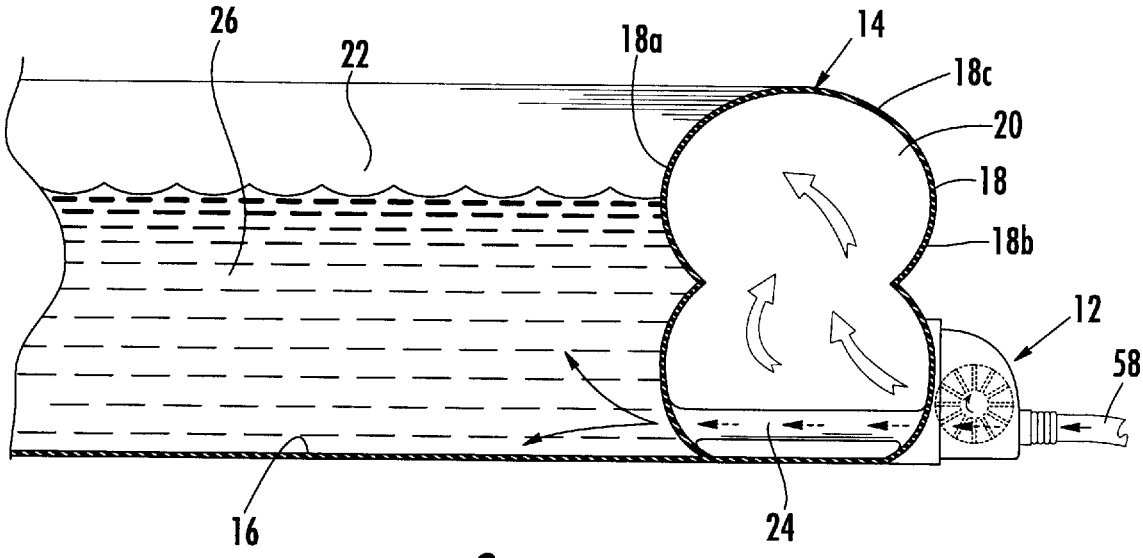
FIG. 3 is a cross-sectional view through the line 3—3 of FIG. 1.
Figure 4:
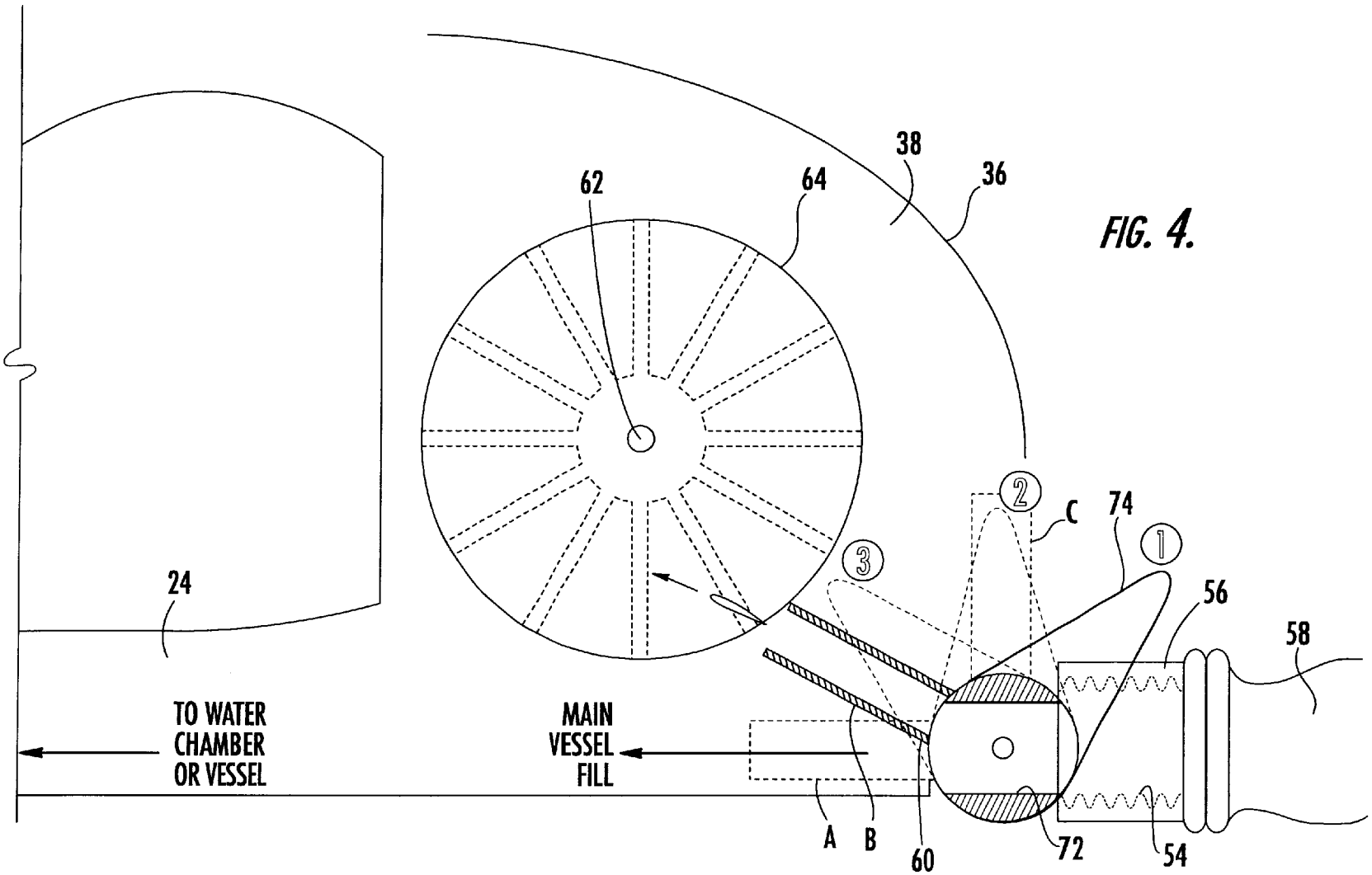
FIG. 4 is a side elevational view of the liquid-powered air pump of the present invention with adjustable internal nozzle.

Referring first to FIGS. 1–4, the device 10 of the preferred embodiment of the present invention is shown to include a child's inflatable swimming pool 14 with an integrated liquid-powered air pump 12. The preferred liquid is water. In FIGS. 1 and 2, the apparatus 10 of the present invention includes a general inflatable swimming pool 14 device with a floor 16 and an inflatable upstanding wall 18 therefrom. The wall 18 has an inner wall 18*a* and an outer wall 18*b* that forms a chamber 20 for receiving air therebetween to inflate the wall 18. The upstanding walls 18*a* and 18*b* also form a water reservoir 22 with the pool floor. The upstanding walls 18*a* and 18*b* are connected to the floor 16 of the swimming pool 14 in an air and water tight manner by heat sealing or other ways known in the art. A water-powered air pump 12 is connected directly to the outer side wall 18*b* and is in fluid communication with the chamber 20 between the inner wall 18*a* and outer wall 18*b* as well as the water reservoir area 22 via a water conduit 24. As shown in FIGS. 2–4, the water conduit 24 is shown as being routed through the air chamber 20 within the side wall 18 of the pool device 14. However, the water conduit 24 may be routed over the top surface 18*c* of the side wall 18 as opposed to being routed through the side walls 18*a* and 18*b*.

Still referring to FIGS. 1 and 4, the water reservoir 22 of the pool device 14 is filled with water 26 and the air chamber 20 in the side wall 18 is filled with air in accordance with the present invention. FIG. 1 shows an example configuration of such a swimming pool device 14 that is of a general circular shape with a double tubular side wall 18, however, other pool configurations may be employed. As shown in FIG. 1, additional pool components are optionally added, such as a water slide 28 and decorative tree 30. As will be described below, additional internal conduits may be provided to supply water to these components so that water can be sprayed from nozzles 32 or orifices present thereon. This additional spraying may be desired to enhance enjoyment and fun of the device 10. For example, additional spraying would be desirable on the ramp 34 of the water slide 28 to facilitate sliding thereon.

Turning now to FIGS. 2–4, the details of the construction of the pump portion 12 of the apparatus 10 and its interface to the inflatable swimming pool 14 is shown. Specifically, the liquid-powered air pump 12 includes an outer housing 36 which is shown in broken lines in FIG. 2 to reveal the internal components thereof. The housing 36 includes an internal chamber which is divided into a water chamber 38 and an air chamber 40 by a partition 41. A water input port 42 and a water output port 44 are provided in fluid communication with the water chamber 38. An air input port 46 and air output port 48 are also provided in fluid communication with the air chamber 40 of the housing 36.

An air-tight releasable closure 50 is provided at the air input port 46. The air output port 48 is in fluid communication with the air chamber 20 within the walls 18*a* and 18*b* of swimming pool device 14 as shown in FIG. 3. Optionally, a valve 52, such as flapper valve, my be provided at the air output port 48 to prevent backflow of air to the environment from within the air chamber 20 of the swimming pool device.

At the water input port 42, a female threaded port 54 is provided to threadably receive a male connector 56 of a standard "garden" water hose 58. A male threaded water-tight closure (not shown) may optionally be threadably secured to the female threaded port 54 to maintain water with the water reservoir 22 if the user wishes to disconnect the hose 58 from the pump 12. The foregoing connection structure is preferred to facilitate connection using a standard water hose; however, other connection methods may be employed. An internal nozzle 60 is provided to accelerate the flow of water 26 through the water input port 42. As shown in FIG. 4 below, the internal nozzle 60 may be adjustable to control the power of the air pump 12. In addition, the water output port 44 is in fluid communication with a water conduit 24 which is, in turn, in fluid communication with the water reservoir 22 defined by the walls 18*a* and 18*b* and floor 16 of the swimming pool device 14.

The preferred embodiment illustrates the water conduit 24 being routed directly through the side wall 18 of the swimming pool 14. Alternatively, the water conduit 24 can be routed above and over the side wall 18 of swimming pool 14 to provide water 26 to the reservoir 22 in a waterfall-type manner. In general, the pump housing 36 is affixed to the outer side wall 18*a* of the swimming pool 14 by heat sealing, water-proof adhesive and other methods known in the art, to thereby integrate the pump 12 directly into the inflatable device 10.

As shown in FIG. 2, the liquid-powered air pump 12 includes a turbine axle 62 which extends through the partition 41 of the pump housing 36 and into communication with the water chamber 38 and the air chamber 40. Preferably, the turbine axle 62 is mounted through the walls of the pump housing 36 and through the partition 41 for additional stability. A water turbine or water impeller 64, with water flanges 66 thereon, is mounted to the turbine axle 62 at a portion of the turbine axle residing within the water chamber 38. An air turbine or air impeller 68, with air flanges 70 thereon, is mounted to the turbine axle 62 at a portion residing within the air chamber 40. As result, rotation of the water flanges 66 about the turbine axle 62 causes the air flanges 70 to rotate as well.

In accordance with the assembly and operation of the present invention, a swimming pool device 14 and integrated air pump 12 is first in a deflated state. A common garden hose 58, connected to a water source (not shown), is threadably secured to the female threaded port 54 at the water input port 42. The water source is then turned on thus creating a flow of water 26 through the hose 58 and into the water chamber 38 via the nozzle 60 which accelerates the flow of water 26. The internal nozzle 60 directs the incoming flow of water 26 into communication with the water flanges 66 of the water turbine 64 thus causing the turbine axle 62 to rotate within the housing 36. As a result, the air turbine 68 and the air flanges 70 thereon rotate. The rotation of the air flanges 70 blows air through the air output port 48 and into the air chamber 20 within the wall 18 of the swimming pool 14 thereby inflating the wall 18 of the swimming pool 14. In accordance with the present invention, the water reservoir 26, defined by the wall 18 of the swimming pool 14, is simultaneously filled with water 26 by the flow of water from the water chamber 38 and through the water conduit 24 which supplies water directly into the water reservoir 22.

Once the desired level of water 26 in the water reservoir 22 and air within the wall 18 of the swimming pool is achieved, the source of water may be turned off thus stopping the filling of the reservoir 22 and inflation of the wall 18 of the swimming pool 14. If a valve 52, such as a flapper valve is employed at the air output port 48, a closure cap 50 is not needed as air will be retained with the wall 18 of the swimming pool 14. If no valve 52 is employed at the air output port 48, the closure cap 50 is secured to the air input port 46 to seal air within the wall 18 of the swimming pool 14. As far as the water side of the pump 12, the hose 58 may simply be left connected to the water input port 42 even if turned off. Such connection will maintain water 26 within the water reservoir 22 due to the backpressure present in the hose 58. Alternatively, a threaded closure cap (not shown) may be secured to the water input port 42 to keep the water 26 in the water reservoir 22 if the hose 58 is disconnected. Still further, if the water conduit 24 is routed over the top of the wall 18 of the swimming pool 14, the water input port 42 need not be closed at all because, in that configuration, the water chamber 38 is not in pressurized fluid communication with the water reservoir 22 thereby obviating the need seal off the water input port 42.

Turning now to FIG. 4, the internal nozzle 60 of the present invention may be made adjustable to control the speed of rotation of the turbine axle 62 to thereby control the relative rates of water flow and air flow to the respective portions of the swimming pool 14. For example, a 3-position ball valve 72 may be employed for this purpose. The side elevational view of FIG. 3 shows an internal nozzle 60 that is pivotally connected to the water input port 42 of the pump housing 36. A handle 74 is connected to the internal nozzle 60 through the housing 36 to permit the user to manipulate the internal nozzle 60 from outside of the pump housing 36. The pivoting internal nozzle 60 allows the user to control the direction of the flow of water 26 within the water chamber 38.

Specifically, as shown in FIG. 4, the internal nozzle 60 may be adjusted to a first position, referenced as A, where the adjustable internal nozzle 60 is directed completely away from the water turbine 64 thus imparting no rotation to the turbine axle 62 resulting in no air flow by the air turbine 68. Position A is desirable when the swimming pool 14 is already inflated but further water flow is desired, such as when the water reservoir 22 requires re-filling or further water flow is desired to supply water 26 to the secondary fanciful nozzles 32 positioned about the device 10. Also, the adjustable internal nozzle 60 may be adjusted to point, for example, directly at the water turbine 64, as generally referenced as position B. In this position, the water flow is directed to the water turbine 61 thereby rotating the turbine axle 62 thus generating air pressure. Position B is be desirable, for example, when first inflating the swimming pool 14 and fast inflation and water flow are both desired. In a nozzle shut-off position, referenced as C, shows further rotation of the adjustable internal nozzle 60 to completely constrict the flow of water from the hose 58. In position C, water flow from the hose 58 is turned off and is appropriately used when no further water or air flow is desired.

Air overflow valves (not shown) may also be provided in the pump housing 36 or in the swimming pool wall 18 itself to allow for release of excess air when a predetermined air pressure within the swimming pool 14 is reached. Such overflow valves may be used to prevent popping of the swimming pool body due to excess air pressure therein.

Moreover, the relative rotational speeds of the water turbine 64 and the air turbine 68 can be further adjusted by modifying the relative sizes and diameters of the water turbine 64 and the air turbine 68 as well at the configuration and number of water flanges 66 and air flanges 70 respectively thereon. For example, it has been found that, with water pressure from typical household water spigots, optimum flow of air results if the water turbine 64 is about half of the size of the air turbine 68. Of course, the relative sizes and configurations of the water turbine 64 and air turbine 68 can be modified to suit the available water pressure, size of the inflatable, and the like.

Referring now to FIGS. 5–7, an alternative embodiment of the present invention is shown to include an air pump 104 with a housing 106 having a water chamber 108 and an air chamber 110 divided by a partition 112. The configuration of the inflatable device 100 and air pump 104 of the alternative embodiment is similar to that of the preferred embodiment of the present invention of FIGS. 1–4 in that it simultaneously delivers both water and air to an inflatable device. In this alternative embodiment, the inflatable device 100 is an upstanding toy that can, for example, spray water, be used as a punching toy, or the like. This inflatable device 100 does not have an open water reservoir as in preferred embodiment but an enclosed water base 102 that retains water 114 to secure the toy in place in addition to an upstanding air inflated portion 116.

As shown in FIGS. 6 and 7, water 114 is delivered to a water turbine 118 and into the base 102 of the device 100 to provide a weighted base to prevent the toy from tipping over. Rotation of the water turbine 118, as described above, rotates an air turbine 120 via a turbine axle 122. Air flow generated by the air turbine 120 forces air through an air conduit 122 and into the inflatable portion 116 of the device 100. Depending on the configuration of the inflatable device 100, the air conduit 122 may pass through the water filled base 102 of the device, as shown in FIG. 7, or may be routed directly into fluid communication with the inflatable portion 116 of the device 100.

As shown in FIGS. 5 and 7, the upstanding device 100 may include additional fanciful components 124, such as water powered streamers, the like to enhance the enjoyment and fun of the toy. Additional water conduits 126, as shown in FIG. 7, may be provided in communication with the flow of water to supply water to these additional components 124.

The inflatable devices 10 and 100 and liquid-powered air pumps 12 and 104 can be formed in a wide array of different configurations. For example, water slides and simulated play houses can be created due to the ability to provide controlled delivery of water and air to an inflatable device. Still further, the liquid-powered air pumps 12 and 104 may be employed as a stand alone unit where a water hose is connected to the water output port and an air hose is connected to the air output port of the pump housing. This stand alone pump provides the simultaneous water and air delivery to existing inflatables, such as a common child's inflatable swimming pool. The water hose connected to the water output port can be routed into the water reservoir portion of the pool. The free end of the air hose, not connected to the air output port, can be configured to interface with a standard valve assembly found on inflatable devices. When the pool is filled with air and the water reservoir is filled with water, the water source is simply turned off, the stand alone unit is removed and the standard valve assembly of the inflatable pool is closed to seal air within the air chamber of the swimming pool.

The inflatable devices can be made of PVC and other known materials. The components parts of the pump 12 and 104 are preferably made of plastic to reduce the cost of and simplify manufacture. However, these parts may be made of metal or other materials as desired.

It would be appreciated by those skilled in the art that various changes and modifications can be made to the illustrated embodiments without departing from the spirit of the present invention. All such modifications and changes are intended to be covered by the appended claims.

What is claimed is:

1. A liquid-powered air pump, comprising:

a first housing defining a liquid chamber; said first housing having an input port and an output port;

a second housing defining an air chamber; said second housing having an input port and an output port; said second housing being positioned proximal to said first housing;

a one-way valve connected to said output port of said first housing;

a turbine axle, having a first portion and a second portion, extending through said first housing and said second housing; said first portion of said turbine axle residing substantially within said first housing; said second portion of said turbine axle residing substantially within said second housing; said turbine axle being rotatable relative to said first housing and said second housing;

a plurality of liquid turbine blades connected to said first portion of said turbine axle in said first housing;

a plurality of air turbine blades connected to said second portion of said turbine axle in said second housing;

whereby introduction of liquid, via said input port of said first housing, into sad liquid chamber of said first housing and into communication of saw plurality of liquid turbine blades rotates said turbine axle and said plurality of air turbine blades connected to said second portion of said turbine axle thereby drawing air in from said input port of said second housing a out through said output port of said second housing; said liquid exiting out through said output port of said first housing.

2. The liquid-powered air pump of claim 1, further comprising:

a nozzle connected to said input port of said first housing.

3. The liquid-powered air pump of claim 2, wherein said nozzle is adjustable relative to said liquid turbine blades.

4. The liquid-powered air pump of claim 2, wherein said nozzle has a reduced diameter relative to said input port of said first housing.

5. The liquid-powered air pump of claim 1, further comprising:

an air-tight closure removably connected to said input port of said second housing.

6. The liquid-powered air pump of claim 1, further comprising:

a liquid-tight closure removably connected to said input port of said first housing.

7. The liquid-powered air pump of claim 1, further comprising:

a female threaded port connected to said input port of said first housing.

8. The liquid-powered air pump of claim 1, further comprising:

a one-way valve connected to said output port of said second housing.

9. A self-inflatable device, comprising:

an air bladder having an interior air chamber;

a liquid container having a fluid receiving port;

a first housing, defining a liquid chamber, having an input port and an output port; said output port of said first housing being connected to said liquid container via said fluid receiving port and in fluid communication with said liquid container;

a second housing, defining an air chamber, having an input port and an output port; said second housing being positioned proximal to said first housing; said output port of said second housing being in find communication with said interior air chamber of said air bladder, a turbine axle, having a first portion and a second portion, extending through said first housing and said second housing; said first portion of said turbine axle residing substantially within said first housing; said second portion of said turbine axle residing substantially within said second housing; said turbine and being rotatable relative to said first housing and said second housing;

a plurality of liquid turbine blades connected to said first portion of said turbine axle in said first housing;

a plurality of air turbine blades connected to said second portion of aid turbine axle in said second housing;

whereby introduction of liquid, via said input port of said first housing, into said liquid chamber of said first housing and into communication of said plurality of liquid turbine blades rotates said turbine axle and said plurality of air turbine blades connected to said second portion of said turbine axle thereby drawing air in from said input port of said second housing and out through said output port of said second housing and into said air interior air chamber of said air bladder; said liquid exiting out through said output port of said first housing and into said liquid container.

10. The self-inflatable device of claim 9, further comprising:

a nozzle connected to said input port of said first housing.

11. The self-inflatable device of claim 9, wherein said nozzle is adjustable relative to said liquid turbine blades.

12. The self-inflatable device of claim 10, wherein said nozzle has a reduced diameter relative to said input port of said first housing.

13. The self-inflatable device of claim 9, further comprising:

an air-tight closure removably connected to said input port of said second housing.

14. The self-inflatable device of claim 9, further comprising:

a liquid-tight closure removably connected to said input port of said first housing.

15. The self-inflatable device of claim 9, further comprising:

a female threaded port connected to said input port of said first housing.

16. The self-inflatable device of claim 9, further comprising:

a one-way valve connected to said output port of said first housing.

17. The self-inflatable device of claim 9, further comprising:

a one-way valve connected to said output port of said second housing.

18. The self-inflatable device of claim 9, wherein said liquid container is enclosed.

19. A self-inflatable device, comprising:

an air bladder having an interior air chamber, a liquid container having a fluid receiving port;

a pump housing:

a partition positioned in said pump housing diving said pump housing into a liquid chamber and an air chamber;

a liquid input port and a liquid output port in fluid communication with said liquid chamber; said liquid output port being connected to said liquid container via said fluid receiving port and in fluid communication with said liquid container;

an air input port and an air output port in fluid communication with said air chamber said air output port being in fluid communication with said air chamber, a turbine axle, having a first portion and a second portion, extending through said partitioning; said first portion of said turbine axle residing substantially within said liquid chamber; said second portion of said turbine axle residing substantiality within said air chamber; said turbine axle being rotatable relative to said pump showing;

a plurality of liquid turbine blades connected to said first portion of said turbine axle in said first housing;

a plurality of air turbine blades connected to said second portion of said turbine axle in said second housing;

whereby introduction of liquid, via said liquid input port into said liquid chamber and into communication with said plurality of liquid turbine blades rotates said turbine axle and said plurality of air turbine blades connected to said second portion of said turbine axle thereby drawing air in from said air input port and out through said air output port of said second housing and into said air interior air chamber of said air bladder; said liquid eyeing out through said liquid output port and into said liquid container.

20. The self-inflatable device of claim 19, further comprising:

a nozzle connected to said liquid input port.

21. The self-inflatable device of claim 19, wherein said nozzle is adjustable relative to said plurality of liquid turbine blades.

22. The self-inflatable device of claim 20, wherein said nozzle has a reduced diameter relative to said liquid input port.

23. The self-inflatable device of claim 19, further comprising:

an air-tight closure removably connected to said air input port.

24. The self-inflatable device of claim 19, further comprising:

an liquid-tight closure removably connected to said liquid input port.

25. The self-inflatable device of claim 19, further comprising:

a female threaded port connected to said liquid input port.

26. The self-inflatable device of claim 19, further comprising:

a one-way valve connected to said liquid output port.

27. The self-inflatable device of claim 19, further comprising:

a one-way valve connected to said air output port.

28. The self-inflatable device of claim 19, wherein said liquid container is enclosed.

29. A self-inflatable device, comprising:

an air bladder having an interior air chamber;

a liquid container;

a pump housing;

a partition positioned in said pump housing diving said pump housing into a liquid chamber and an air chamber;

a liquid input port and a liquid output port in fluid communication with said liquid chamber said liquid output port being in fluid communication with said liquid container;

a one-way valve connected to said liquid output port;

an air input port and an air output port in fluid communication with said air chamber; said air output port being in fluid communication with said air chamber;

a turbine axle, having a first portion and a second porting, extending through said partition; said first portion of said turbine axle residing substantially within said liquid chamber, said second portion of said turbine axle residing substantially within said air chamber; said turbine axle being rotatable relative to said pump housing;

a plurality of liquid turbine blades connected to said first portion of said turbine axle in said first housing;

a plurality of air turbine blades connected to said second portion of said turbine chamber in said second housing;

whereby introduction of liquid, via said liquid input port into said liquid chamber and into communication with said plurality of liquid turbine blades rotates said turbine axle and said plurality of air turbine blades connected to said second portion of said turbine axle thereby drawing air in from said air input port and out through said air output port of said second housing and into said air interior air chamber of said air bladder; said liquid exiting out through said liquid output port and into said liquid container.

30. The self-inflatable device of claim 29, further comprising:

a nozzle connected to said liquid input port.

31. The self-inflatable device of claim 29, wherein said nozzle is adjustable relative to said plurality of liquid turbine blades.

32. The self-inflatable device of claim 30, wherein said nozzle has a reduced diameter relative to said liquid input port.

33. The self-inflatable device of claim 29, further comprising:

an air-tight closure removably connected to said air input port.

34. The self-inflatable device of claim 29, further comprising:

an liquid-tight closure removably connected to said liquid input port.

35. The self-inflatable deice of claim 29, further comprising:

a female threaded port connected to said liquid input port.

36. The self-inflatable device of claim 29, further combing:

a one-way valve connected to said air output port.

37. The self-inflatable device of claim 29, wherein said liquid container is enclosed.

38. A liquid-powered air pump, comprising:

a first housing having a liquid chamber; said first housing having an input port and an output port;

a directionally adjustable nozzle connected to said input port of said first housing;

a second housing defining an air chamber; said second housing having an input port and an output port; said second housing being positioned proximal to said first housing;

a turbine axle, having a first portion and a second portion, extending through said first housing and said second housing; said first portion of said turbine axle residing substantially within said first housing; said second portion of said turbine axle residing substantially within said second housing; said turbine axle being rotatable relative to said first housing and said second housing;

a plurality of liquid turbine blades connected to said first portion of said turbine axle in said first housing;

a plurality of air turbine blades connected to said second portion of said turbine axle in said second housing;

whereby introduction of liquid, via said input port of said first housing, into said liquid chamber of said first housing and into communication of said plurality of liquid turbine blades rotates said turbine axle and said plurality of air turbine blades connected to said second portion of said turbine axle thereby drawing air in from said input port of said second housing and out through said output port of said second housing; said liquid exiting out through said output port of said first housing.

39. The liquid-powered air pump of claim 38, wherein said nozzle has a reduced diameter relative to said input port of said first housing.

40. The liquid-powered air pump of claim 39, further comprising:

an air-tight closure removably connected to said input port of said second housing.

41. The liquid-powered air pump of claim 39, further comprising:

an liquid-tight closure removably connected to said input port of said first housing.

42. The liquid-powered air pump of claim 39, further comprising:

a female threaded port connected to said input port of said first housing.

43. The liquid-powered air pump of claim 39, further comprising:

a one-way valve connected to said output port of said first housing.

44. The liquid-powered air pump of claim 39, further comprising:

a one-way valve connected to said output port of said second housing.

* * * * *